US011145140B2

(12) United States Patent
Hiura et al.

(10) Patent No.: US 11,145,140 B2
(45) Date of Patent: Oct. 12, 2021

(54) SYSTEM FOR EVALUATING MONITORING PLAN, AND METHOD FOR EVALUATING MONITORING PLAN

(71) Applicant: MITSUBISHI HEAVY INDUSTRIES MACHINERY SYSTEMS, LTD., Hyogo (JP)

(72) Inventors: Ryota Hiura, Tokyo (JP); Takeshi Fukase, Tokyo (JP); Takuma Okazaki, Tokyo (JP); Tetsuya Adachi, Tokyo (JP)

(73) Assignee: MITSUBISHI HEAVY INDUSTRIES MACHINERY SYSTEMS, LTD., Hyogo (JP)

( * ) Notice: Subject to any disclaimer, the term of this patent is extended or adjusted under 35 U.S.C. 154(b) by 496 days.

(21) Appl. No.: 15/543,565

(22) PCT Filed: Jan. 16, 2015

(86) PCT No.: PCT/JP2015/051090

§ 371 (c)(1),
(2) Date: Jul. 13, 2017

(87) PCT Pub. No.: WO2016/113910

PCT Pub. Date: Jul. 21, 2016

(65) Prior Publication Data

US 2017/0372531 A1 Dec. 28, 2017

(51) Int. Cl.
*G07B 15/06* (2011.01)
*G07B 15/00* (2011.01)
(Continued)

(52) U.S. Cl.
CPC ..... *G07B 15/063* (2013.01); *G07B 15/00* (2013.01); *G07B 15/06* (2013.01); *G08G 1/01* (2013.01);
(Continued)

(58) Field of Classification Search
CPC .... G07B 15/068; G07B 15/00; G07B 15/063; G07B 15/06; G08G 1/01; G08G 1/0116;
(Continued)

(56) References Cited

U.S. PATENT DOCUMENTS 7,127,413 B1 10/2006 Yanagisawa et al.
2003/0189498 A1 10/2003 Kakihara et al.
(Continued)

FOREIGN PATENT DOCUMENTS

JP 9-319904 A 12/1997
JP 11-232507 A 8/1999
(Continued)

OTHER PUBLICATIONS

Automatic Toll Collection System Using RFID Published by International Journal of Computer Science and Mobile Computing (Year: 2016).*
(Continued)

*Primary Examiner* — Zeina Elchanti
(74) *Attorney, Agent, or Firm* — Kanesaka Berner and Partners LLP

(57) ABSTRACT

This monitoring plan evaluation system includes a vehicle monitoring information acquisition unit which acquires vehicle monitoring information indicating a result of monitoring of a vehicle, the vehicle monitoring information including monitoring execution condition information indicating at least one of a monitoring place and a monitoring time of the vehicle and information of the vehicle that has been subjected to monitoring at the monitoring place or the monitoring time, a movement information acquisition unit which acquires vehicle movement information regarding movement of each of a plurality of vehicles, and a passage extent information generator which generates passage extent information, which indicates an extent of passage of a
(Continued)

vehicle that is to be monitored in a condition indicated by a candidate monitoring execution condition including at least one of a place and a time where and when to monitor vehicles, on the basis of the vehicle movement information and the vehicle monitoring information.

5 Claims, 4 Drawing Sheets

(51) Int. Cl.

| | |
|---|---|
| ***G08G 1/017*** | (2006.01) |
| ***G08G 1/01*** | (2006.01) |
| ***G08G 1/065*** | (2006.01) |
| ***G08G 1/127*** | (2006.01) |

(52) U.S. Cl.
CPC ..... *G08G 1/0116* (2013.01); *G08G 1/0129* (2013.01); *G08G 1/0175* (2013.01); *G08G 1/065* (2013.01); *G08G 1/127* (2013.01)

(58) Field of Classification Search
CPC .... G08G 1/0129; G08G 1/0175; G08G 1/065; G08G 1/127
See application file for complete search history.

(56) References Cited

U.S. PATENT DOCUMENTS

| | | | | |
|---|---|---|---|---|
| 2014/0172521 | A1 | 6/2014 | Itaya et al. | |
| 2015/0100394 | A1* | 4/2015 | Povolny | G06K 9/78 705/13 |
| 2015/0154578 | A1* | 6/2015 | Aggarwal | G07B 15/063 705/13 |
| 2015/0279122 | A1* | 10/2015 | Lorenzen | H04L 67/12 705/13 |

FOREIGN PATENT DOCUMENTS

| | | | |
|---|---|---|---|
| JP | 2000-163609 | A | 6/2000 |
| JP | 2002251641 | A | 9/2002 |
| JP | 2005352615 | A | 12/2005 |
| KR | 10-2001-0070744 | A | 7/2001 |
| KR | 10-1191908 | B1 | 10/2012 |
| KR | 10-1192734 | B1 | 10/2012 |
| WO | 2013018656 | A1 | 2/2013 |

OTHER PUBLICATIONS

International Search Report in PCT/JP2015/051090, dated Apr. 14, 2015, 2pp.
Written Opinion of the ISA in PCT/JP2015/051090, dated Apr. 14, 2015, 7pp.

* cited by examiner

FIG. 2

| ON-BOARD UNIT ID | BILLING POSITION | BILLING TIME | BILLING DETAILS |
|---|---|---|---|
| ・・・ | ・・・ | ・・・ | ・・・ |
| ・・・ | ・・・ | ・・・ | ・・・ |
| ⋮ | ⋮ | ⋮ | ⋮ |

FIG. 3

| ON-BOARD UNIT ID | TRAVEL POSITION | TRAVEL TIME |
|---|---|---|
| ・・・ | ・・・ | ・・・ |
| ・・・ | ・・・ | ・・・ |
| ⋮ | ⋮ | ⋮ |

SYSTEM FOR EVALUATING MONITORING PLAN, AND METHOD FOR EVALUATING MONITORING PLAN

RELATED APPLICATIONS

The present application is a National Phase of International Application No. PCT/JP2015/051090, filed Jan. 16, 2015.

TECHNICAL FIELD

The present invention relates to a monitoring plan evaluation system and a monitoring plan evaluation method.

BACKGROUND ART

In a method of performing a process of billing toll fees of a toll road or the like, an on-board unit performs a billing process and some technologies have been suggested in association with the method.

For example, an on-board unit for toll collection which performs position orientation of a passing vehicle through a global positioning system (GPS) and which performs a billing process on the basis of billing conditions and positional information of the vehicle is described in Patent Document 1.

In such a scheme in which an on-board unit performs a billing process on the basis of positional information of a vehicle, the on-board unit can autonomously perform a billing process even at a place without road-side facilities. Accordingly, in this scheme, it is possible to reduce road-side facilities and to flexibly set or change billing conditions.

RELATED ART DOCUMENT

Patent Document

Patent Document 1: Japanese Unexamined Patent Application, First Publication No. H9-319904

SUMMARY

Problems to be Solved by the Invention

However, in the billing scheme which uses on-board units, corresponding proper on-board units need to be mounted to vehicles. Therefore, proper billing may fail to be performed when cheating with an on-board unit has been done such as removal of an on-board unit from a vehicle or mounting of a non-corresponding on-board unit to a vehicle. From the viewpoint of smoothly or fairly performing billing, it is important to monitor vehicles to detect and crack down on cheating vehicles.

Particularly, in the case where on-board units autonomously perform a billing process on the basis of their positions, the billing process is not performed externally and therefore once cheating is done such that an on-board unit is removed from a vehicle, the cheating cannot be detected externally when a billing process is performed. Accordingly, in spite of the situation where an on-board unit needs to be mounted to a vehicle (for example, in spite of the situation where it is compulsory that an on-board unit is mounted to every vehicle), once cheating is done such that an on-board unit is removed from a vehicle, a necessary billing process is not performed on the vehicle where the cheating has been done. Therefore, in the case where on-board units autonomously perform a billing process, there is a greater need to monitor vehicles to detect and crack down on cheating vehicles.

However, it is considered that the situation of passage of vehicles, where cheating to be cracked down on such as cheating with the on-board unit described above has been done, varies depending on the place or time and it is also considered that the situation of detection of vehicles where cheating has been done varies depending on the place or time where or when monitoring is performed to conduct a crackdown. Therefore, there is a need to be able to predict at least one of the place and the time where and when it is possible to efficiently detect vehicles where cheating is being done.

The present invention provides a monitoring plan evaluation system and a monitoring plan evaluation method which can provide information for predicting at least one of a place and a time where and when it is possible to efficiently detect vehicles where cheating is being done.

Means for Solving the Problem

According to a first aspect of the present invention, a monitoring plan evaluation system (100) includes a vehicle monitoring information acquisition unit (110) which acquires vehicle monitoring information indicating a result of monitoring of a vehicle, the vehicle monitoring information including monitoring execution condition information indicating at least one of a monitoring place and a monitoring time of the vehicle and information of the vehicle that has been subjected to monitoring at the monitoring place or the monitoring time, a movement information acquisition unit (110) which acquires vehicle movement information regarding movement of each of a plurality of vehicles, and a passage extent information generator (191) which generates passage extent information, which indicates an extent of passage of a vehicle that is to be monitored in a condition indicated by a candidate monitoring execution condition including at least one of a place and a time where and when to monitor vehicles, on the basis of the vehicle movement information and the vehicle monitoring information.

Here, the vehicle that is to be monitored is a vehicle that greatly needs to be monitored since it is highly likely that vehicle-related cheating has been done.

According to the monitoring plan evaluation system according to the first aspect, it is possible to generate passage extent information indicating the extent of passage of vehicles that are to be monitored in a condition indicated by each candidate monitoring execution condition by considering the results of monitoring of each vehicle acquired from the vehicle monitoring information. Through this passage extent information, it is possible to provide information for predicting at least one of a monitoring place and a monitoring time where and when it is possible to efficiently detect a vehicle which is to be monitored, i.e., a vehicle where it is highly likely that vehicle-related cheating has been done.

The monitoring plan evaluation system may include a candidate selector (192) which selects one or more candidate monitoring execution conditions from a plurality of candidate monitoring execution conditions on the basis of the passage extent information.

This makes it possible to efficiently detect a vehicle where cheating has been done by installing a monitoring system according to a place or a time selected by the candidate selector.

The passage extent information generator may generate map information including information indicating an extent of passage of a vehicle that is to be monitored as the passage extent information.

This makes it possible to determine a place or a time where or when to perform monitoring while viewing, through the map information including the passage extent information, locations where it is expected that a vehicle to which no on-board unit is mounted can be efficiently detected.

The passage extent information generator may extract at least one of a monitoring place and a monitoring time where and when a vehicle has been monitored last on the basis of the vehicle monitoring information while extracting a candidate monitoring execution condition through which the vehicle has passed after the monitoring place or the monitoring time where or when the vehicle has been monitored last on the basis of a travel history indicated by the vehicle movement information and may then generate the passage extent information on the basis of at least one of a time interval, a travel distance, and a billed amount from when the vehicle has been monitored last to when the vehicle has passed through the extracted candidate monitoring execution condition.

This allows the passage extent information generator to generate passage extent information indicating an extent that varies according to at least one of the time interval, the travel distance, and the billed amount from when the vehicle has been monitored last to when the vehicle has passed through the extracted candidate monitoring execution condition. Therefore, for example, it is possible to more highly evaluate a condition indicated by the candidate monitoring execution condition as a condition where a vehicle to be monitored is passing (i.e., a condition more suitable for monitoring a cheating vehicle) as the candidate monitoring execution condition is passed by a larger number of vehicles when a time has elapsed after they have been monitored or the candidate monitoring execution condition is passed by a larger number of vehicles which have traveled a long distance or to which a large amount has been billed after they have been monitored.

The passage extent information generator may obtain at least a billed amount from when the vehicle has been monitored last to when the vehicle has passed through the extracted candidate monitoring execution condition and generate passage extent information such that the extent of passage of the vehicle that is to be monitored increases as the billed amount of the vehicle passing through the candidate monitoring execution condition increases.

This allows the passage extent information generator to present a place or a time suitable for monitoring for preventing or detecting evasion of billing of a large amount. Therefore, for example, by performing monitoring at the place or the time, the operator of the automatic billing system can efficiently perform monitoring for preventing or detecting evasion of billing of a large amount.

According to a second aspect of the present invention, a monitoring plan evaluation method includes a vehicle monitoring information acquisition step acquiring vehicle monitoring information indicating a result of monitoring of a vehicle, the vehicle monitoring information including monitoring execution condition information indicating at least one of a monitoring place and a monitoring time of the vehicle and information of the vehicle that has been subjected to monitoring at the monitoring place or the monitoring time, a movement information acquisition step acquiring vehicle movement information regarding movement of each of a plurality of vehicles, and a passage extent information generation step generating passage extent information, which indicates an extent of passage of a vehicle that is to be monitored in a condition indicated by a candidate monitoring execution condition including at least one of a place and a time where and when to monitor vehicles, on the basis of the vehicle movement information and the vehicle monitoring information.

According to the monitoring plan evaluation method according to the second aspect, it is possible to generate passage extent information indicating the extent of passage of vehicles that are to be monitored in a condition indicated by each candidate monitoring execution condition by considering the results of monitoring of each vehicle acquired from the vehicle monitoring information. Through this passage extent information, it is possible to obtain information for predicting at least one of a monitoring place or a monitoring time where it is possible to efficiently detect a vehicle which is to be monitored, i.e., a vehicle where it is highly likely that vehicle-related cheating has been done.

Advantage of the Invention

According to the monitoring plan evaluation system and the monitoring plan evaluation method described above, it is possible to provide information for predicting at least one of a place and a time where and when it is possible to efficiently detect a vehicle where cheating has been done.

BRIEF DESCRIPTION OF THE DRAWINGS

FIG. 2 is an explanatory diagram illustrating an example data structure of billing information in the embodiment.

FIG. 3 is an explanatory diagram illustrating an example data structure of trip data in the embodiment.

DESCRIPTION OF THE EMBODIMENTS (Constitution and Operation of Monitoring Plan Evaluation Server Device)

Although embodiments of the present invention will hereinafter be described, the embodiments do not limit the invention according to the claims. Not all features in a combination of features described in each of the embodiments are essential in the solution of the invention.

Figure 1:
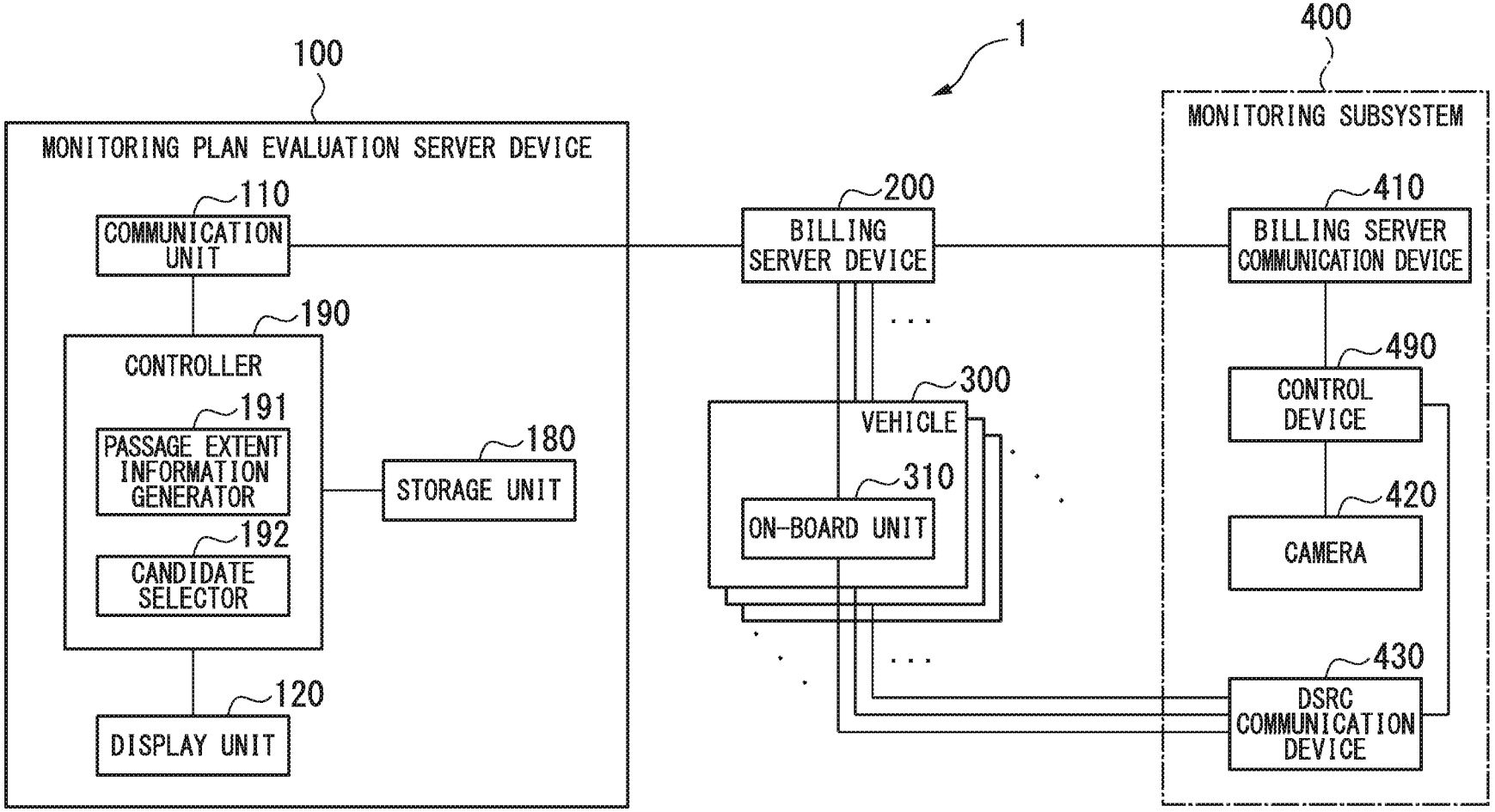
FIG. 1 is a schematic block diagram illustrating a functional constitution of an automatic billing system in an embodiment of the present invention.

FIG. 1 is a schematic block diagram illustrating a functional constitution of an automatic billing system in an embodiment of the present invention. As shown in FIG. 1, an automatic billing system 1 includes a monitoring plan evaluation server device 100, a billing server device 200, and monitoring subsystems 400. The monitoring plan evaluation server device 100 includes a communication unit 110, a display unit 120, a storage unit 180, and a controller 190. The controller 190 includes a passage extent information generator 191 and a candidate selector 192. In the present embodiment, each of the monitoring subsystems 400 includes a billing server communication device 410, a camera 420, a dedicated short range communication (DSRC) device 430, and a control device 490.

The monitoring subsystems 400 included in the automatic billing system 1 are installed at positions where passing vehicles are monitorable in an area through which vehicles to be monitored pass. The number of the monitoring subsystems 400 is arbitrary. Some or all of the monitoring subsystems 400 may not yet be installed. For example, some or all of the monitoring subsystems 400 may be scheduled to be installed.

The billing server device 200 has a communication means that performs communication with an on-board unit 310 to perform a billing process on a user of a vehicle 300, to which the on-board unit 310 is mounted, using the on-board unit. The communication means may include, but is not limited to, a means that can perform wide area communication using, for example, a mobile phone communication network. The DSRC communication device 430 in each monitoring subsystem 400 is a means that can perform narrow area communication and performs communication with the on-board unit 310 included in each of a plurality of vehicles 300 that pass through a monitoring point near a position where the monitoring subsystem 400 is installed. The DSRC communication device 430 is an example of the means which allows the monitoring subsystem 400 to perform communication with the on-board unit 310 and, for example, a means that can perform wide area communication may also be employed as the means.

The automatic billing system 1 is a system that performs billing on vehicles that travel on a toll road.

The automatic billing system 1 performs a billing process upon detecting that the on-board unit 310 has satisfied a billing condition. Examples of the billing condition may include, but are not limited to, a condition that the vehicle has traveled through a specific place. For example, the billing condition may include a time-related condition such as a condition that the vehicle has traveled through a specific place in a specific time zone. The billing condition may also include a distance-related condition. For example, billing may be made at intervals of a predetermined distance within a specific area.

The vehicle mentioned here is a conveyance that travels on a road such as an automobile or a two-wheel vehicle. The place mentioned here may be a road or a section of a road or may be a zone including at least a part of a plurality of roads or may be a location. The location mentioned here may be a point or may be a line in the widthwise direction of a road.

The on-board unit 310 transmits billing information indicating details of a billing process that the on-board unit 310 itself has performed to the billing server device 200.

FIG. 2 is an explanatory diagram illustrating an example data structure of billing information. As shown in FIG. 2, the billing information is configured as data in a tabular form and an on-board unit ID, a billing position, a billing time, and billing details are associated with each other in each row. The on-board unit ID mentioned here is information for identifying the on-board unit.

This data structure allows the billing information to indicate an on-board unit which is mounted to the vehicle, a billing point where billing has been made, the time when billing has been made, and a billed amount.

The on-board unit 310 also transmits trip data to the billing server device 200. The trip data mentioned here is data indicating a travel route of the vehicle.

FIG. 3 is an explanatory diagram illustrating an example data structure of trip data. As shown in FIG. 3, the trip data is configured as data in a tabular form and an on-board unit ID, a travel position, and a travel time are associated with each other in each row. This data structure allows the trip data to indicate an on-board unit which is mounted to a vehicle and where and when the vehicle has traveled.

Various forms may be used as an expression form of the travel position. For example, a history of roads or road sections which the vehicle has traveled may be indicated by identification information of the roads or identification information of the road sections. The history of road sections may be acquired by performing a process of map matching between detected positions and map information including identification information of roads or road sections that has been previously acquired. Alternatively, a history of positions of the vehicle may be indicated by associating sampling times with longitudes and latitudes representing positions of the vehicle at the sampling times.

The on-board unit 310 is, for example, an on-board unit that includes a global navigation satellite system (GNSS) receiver and performs a billing process on the basis of the position of the vehicle. The on-board unit 310 generates trip data on the basis of positional information acquired by the GNSS receiver. Alternatively, the on-board unit 310 may acquire trip data or positional information of the vehicle from another device such as a car navigation system.

In response to a query from the monitoring subsystem 400, the on-board unit 310 transmits information indicating that the on-board unit 310 itself is mounted to the vehicle to the monitoring subsystem 400. An on-board unit ID may be, but not necessarily be, used as the information indicating that the on-board unit 310 itself is mounted to the vehicle.

The billing server device 200 has information indicating a correlation between on-board unit IDs and vehicle numbers of vehicles. This allows vehicles to be associated one-to-one with on-board units. In the present embodiment, the vehicle numbers are, for example, numbers that are displayed such that they are visible from the outside such as numbers written on number plates attached to vehicles (i.e., vehicle identification plates). The billing server device 200 stores billing information or trip data transmitted by each of the on-board units 310. The billing server device 200 transmits the trip data and the billing information to the monitoring plan evaluation server device 100.

In the present embodiment, the monitoring subsystem 400 detects a vehicle to which no on-board unit 310 is mounted. The following description will be given with reference to the case where it is compulsory that on-board units 310 are mounted to all vehicles as an example, but the application range of the present embodiment is not limited to this. For example, when it is compulsory that on-board units 310 are mounted to all vehicles that pass through a billing point, the monitoring subsystem 400 may detect vehicles to which no on-board units 310 are mounted immediately after they have passed through the billing point. The billing point mentioned here is a place where billing is made.

The billing server communication device 410 performs communication with the billing server device 200. Particularly, the billing server communication device 410 receives information indicating a correlation between vehicle numbers and on-board unit IDs from the billing server device 200. The billing server communication device 410 transmits information indicating the results of detection of vehicles to which no on-board units 310 are mounted to the billing server device 200.

The camera 420 captures an image of a monitoring point. In the present embodiment, the camera 420 is configured to continually capture an image at intervals of a period such that a vehicle traveling on the road is included in at least one image but the present invention is not limited to this. For example, the monitoring subsystem 400 may include a vehicle detector and the camera 420 may be configured to capture an image when a vehicle has been detected by the vehicle detector. The monitoring point mentioned here is a point set on a road on which vehicles travel to detect vehicles to which no on-board units 310 are mounted in a place specified as a monitoring place. Therefore, in the case where a position has been specified as the monitoring place, the monitoring place matches a monitoring point. In the case where a range or road ID has been specified as the monitoring place, the monitoring point indicates a position included in the monitoring place. In the present embodiment, it is assumed that a position is specified as a monitoring place and the monitoring place matches a monitoring point.

The DSRC communication device 430 performs communication with the on-board unit 310. Particularly, the DSRC communication device 430 transmits, to the vehicle, a query as to whether or not an on-board unit 310 is mounted to the vehicle. The DSRC communication device 430 receives, from the on-board unit 310, information indicating that the on-board unit 310 itself is mounted to the vehicle as a response to the query.

The control device 490 controls each part of the monitoring subsystem 400 to perform vehicle monitoring.

Specifically, the control device 490 determines whether or not a vehicle positioned at the monitoring point is present by determining whether or not a picture of the vehicle is included in the image of the camera 420. When a picture of a vehicle is included in the image, the control device 490 performs pattern recognition of a number plate of the vehicle included in the image and extracts a vehicle number displayed on the recognized number plate through an OCR process or the like. Upon determining that a vehicle positioned at the monitoring point is present, the control device 490 determines whether or not an on-board unit 310 is mounted to the vehicle according to whether or not communication has been established with the on-board unit 310 through the DSRC communication device 430. When communication between the DSRC communication device 430 and the on-board unit 310 has not been established for a predetermined time, the control device 490 configures information of the vehicle which has been subjected to monitoring using information indicating that a cheating vehicle to which no on-board unit 310 is mounted has been detected and a vehicle number of the vehicle. The control device 490 then transmits vehicle monitoring information, which includes monitoring execution condition information regarding a monitoring place and a monitoring time of the vehicle 300 that has been monitored by the monitoring subsystem 400 and the information of the vehicle that has been subjected to monitoring, to the billing server device 200 via the billing server communication device 410.

When communication between the DSRC communication device 430 and the on-board unit 310 has been established, the control device 490 determines whether or not a proper on-board unit 310 is mounted to the vehicle. For example, the control device 490 determines whether or not an improper on-board unit 310 is mounted to the vehicle according to whether or not an on-board unit ID acquired by querying the vehicle and the vehicle number acquired from the image of the vehicle are associated with each other in the correlation information stored in the billing server device 200. Upon determining that an improper on-board unit 310 is mounted to the vehicle, the control device 490 configures information of the vehicle which has been subjected to monitoring using information indicating that a vehicle to which an improper on-board unit 310 is mounted has been detected and a vehicle number of the vehicle. The control device 490 then transmits vehicle monitoring information, which includes monitoring execution condition information regarding a monitoring place and a monitoring time of the vehicle 300 that has been monitored by the monitoring subsystem 400 and the information of the vehicle that has been subjected to monitoring, to the billing server device 200 via the billing server communication device 410.

Upon determining that a proper on-board unit 310 is mounted to the vehicle, the control device 490 configures information of the vehicle which has been subjected to monitoring using information indicating that a vehicle to which a proper on-board unit 310 is mounted has been detected and a vehicle number of the vehicle. The control device 490 then transmits vehicle monitoring information, which includes monitoring execution condition information regarding a monitoring place and a monitoring time of the vehicle 300 that has been monitored by the monitoring subsystem 400 and information of the vehicle that has been subjected to monitoring, to the billing server device 200 via the billing server communication device 410.

In this manner, the monitoring subsystem 400 is installed at a monitoring place to collect information of vehicles through the camera 420 or the DSRC communication device 420, which makes it possible to collect objective travel facts of vehicles which are traveling and thus to enhance evidence when vehicles where cheating is being done are monitored. In addition, the monitoring subsystem 400 can transmit the collected vehicle information to the billing server device 200 through the billing server communication device 410 and therefore it is possible to efficiently accumulate and analyze the collected vehicle information.

In the above description, the control device 490 of the monitoring subsystem 400 queries a correlation between vehicle IDs and vehicle numbers, but the present invention is not limited to this and the billing server device 200 may also query the correlation. In this case, simply, an on-board unit ID and a vehicle number acquired from the image captured by the camera 420 are associated with each other and are then transmitted from the control device 490 to the billing server device 200 via the billing server communication device 400. The billing server device 200 then determines whether or not an improper on-board unit 310 is mounted to the vehicle according to whether or not the on-board unit ID and the vehicle number associated with each other match each other in correlation information stored in the billing server device 200 and configures information of the vehicle which has been subjected to monitoring, together with the vehicle number of the vehicle, on the basis of a result of the determination.

Here, the monitoring subsystem 400 may be configured as a single device and may be configured as a combination of two or more devices. A single billing server communication device 410 and a single control device 490 may also be commonly used by a plurality of monitoring subsystems 400.

The monitoring subsystem 400 may be installed exclusively for a specific monitoring point at a specific position near the monitoring point. Alternatively, the monitoring subsystem 400 may be installed movable. For example, the monitoring subsystem 400 may be installed on a vehicle.

The monitoring plan evaluation server device 100 provides information for determining a monitoring execution condition for monitoring a cheating vehicle by the monitoring subsystem 400. In the present embodiment, the vehicle's cheating includes a behavior of mounting no on-board unit and a behavior of mounting a non-corresponding, improper on-board unit. The vehicle's cheating may also include at least one of a behavior of mounting no on-board unit and a behavior of mounting a non-corresponding, improper on-board unit and may also include cheating other than a behavior of mounting no on-board unit and a behavior of mounting a non-corresponding, improper on-board unit.

In the present embodiment, the monitoring execution condition is the monitoring place of the vehicle. The monitoring execution condition is not limited to the monitoring place and may be both the monitoring place and the monitoring time of the vehicle. In this case, the monitoring time and the monitoring place when and where monitoring is to be performed are indicated as the condition. The monitoring execution condition may be the monitoring time alone. In this case, only the monitoring time is indicated as the condition with a fixed place or an arbitrary place being used as the monitoring place.

Such a monitoring plan evaluation server device 100 is configured to include, for example, a computer.

The monitoring plan evaluation server device 100 is an example of the monitoring plan evaluation system. However, the monitoring plan evaluation system may be configured as a single device and may be configured by combining a plurality of devices.

The communication unit 110 performs communication with the billing server device 200. Particularly, the communication unit 110 functions as a movement information acquisition unit and receives trip data as vehicle movement information regarding movements of vehicles from the billing server device 200.

The display unit 120 has a display screen such as, for example, a liquid crystal panel to display a variety of images such as still images, moving images, or text (characters). Particularly, the display unit 120 displays information for determining a place where to perform monitoring of whether or not an on-board unit is mounted to a vehicle.

The storage unit 180 is configured to include a storage device provided in the monitoring plan evaluation server device 100 and stores a variety of information. Particularly, the storage unit 180 stores candidate monitoring execution conditions which are candidates for a monitoring execution condition for monitoring by the monitoring subsystem. In the monitoring plan evaluation server device 100 of the present embodiment, the monitoring place of the vehicle is indicated as the monitoring execution condition as described above and therefore the storage unit 180 stores a plurality of monitoring places as the candidate monitoring execution conditions. When the monitoring execution condition is a monitoring time, a plurality of monitoring times is stored as the candidate monitoring execution conditions. When the monitoring execution condition is both the monitoring place and the monitoring time, a plurality of sets, each including a monitoring place and a monitoring time, is stored as the candidate monitoring execution conditions. For example, the candidate monitoring execution conditions are input to the monitoring plan evaluation server device 100 in advance by an operator of the automatic billing system 1.

The controller 190 controls each part of the monitoring plan evaluation server device 100 to perform various processes. The controller 190 is realized, for example, by a computer provided in the monitoring plan evaluation server device 100 reading and executing a program from the storage unit 180.

The passage extent information generator 191 generates passage extent information indicating the extent of passage of vehicles that are to be monitored in a condition indicated by a candidate monitoring execution condition on the basis of vehicle monitoring information and trip data. When the candidate monitoring execution conditions are monitoring places, each of the monitoring places indicating the candidate monitoring execution conditions is used as a monitoring execution condition and the passage extent information indicates the extent to which vehicles to be monitored are passing through the monitoring place. When the candidate monitoring execution conditions are monitoring times, each of the monitoring times indicating the candidate monitoring execution conditions is used as a monitoring execution condition and the passage extent information indicates the extent to which vehicles to be monitored are passing at the monitoring time. When the candidate monitoring execution conditions are monitoring places and monitoring times, each combination of a monitoring place and a monitoring time indicated by the candidate monitoring execution conditions is used as a candidate for the monitoring execution condition and the passage extent information indicates the extent to which vehicles to be monitored are passing at the combination of the monitoring place and the monitoring time.

More specifically, the passage extent information generator 191 calculates a score that is given to the candidate monitoring execution condition by vehicles that have passed through the candidate monitoring execution condition on the basis of vehicle monitoring information and trip data acquired by the communication unit 110. In the present embodiment, a higher score indicates that a candidate monitoring execution condition (i.e., a monitoring place and a monitoring time) given the score is more suitable for monitoring of cheating vehicles.

Score calculation performed by the passage extent information generator 191 is described below with reference to FIGS. 4 and 5.

Figure 4:
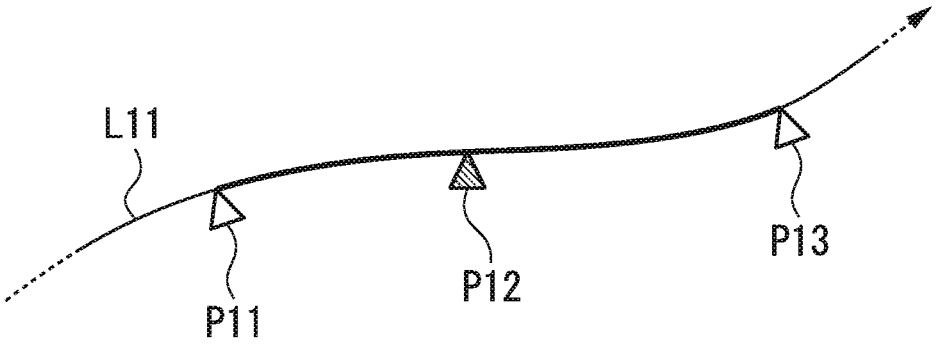
FIG. 4 is an explanatory diagram illustrating an example travel route of a vehicle from a monitoring point to a monitoring point in the embodiment.

FIG. 4 is an explanatory diagram illustrating an example travel route of a vehicle. In FIG. 4, a line L11 indicates a travel route of a vehicle. This travel route is indicated by trip data. Points P11 and P13 indicate monitoring places, each of which is stored as a candidate monitoring execution condition. Here, it is assumed that the point P11 is a point where monitoring of the vehicle has been actually performed by the monitoring subsystem 400. Information indicating that the point P11 is a point where monitoring of the vehicle has been performed is acquired on the basis of vehicle monitoring information transmitted to the communication unit 110 from the billing server 200 on the basis of a result of monitoring by the monitoring subsystem 400 which has performed monitoring at the point P11. It is also assumed that the point P13 is a point where monitoring of the vehicle has not been performed when the vehicle has traveled on the line L11, although it is a candidate monitoring execution condition, and which is to be a candidate for a monitoring place thereafter. A point P12 indicates a billing point where billing is made. Information regarding billing made at the point P12 is acquired on the basis of billing information transmitted to the communication unit 110 from the billing server 200 after being generated through communication with the on-board unit 310.

In the travel route indicated by the line L11, the point P11 where monitoring has actually been performed, the billing point P12, and the point P13 which is to be a candidate for a monitoring place are passed by the vehicle in this order. That is, as described above, the vehicle is monitored by the monitoring subsystem 400 at the point P11 and a billing process is then performed on the vehicle as the vehicle passes through the billing point P12, and the vehicle then passes through the point P13 which is a candidate for a monitoring place. In the above description, it is assumed that monitoring has not been performed at any point which is to be a candidate for a monitoring point for ease of description, but the present invention is not limited to this. When there is a need to reconsider a place as a candidate for a monitoring place although the place was monitored in the past, the place where monitoring was performed in the past may be selected as a candidate for a monitoring place. The same is true in an example of FIG. 5 described later.

Here, it is considered that the efficiency of monitoring varies depending on the time distribution or the arrangement of the monitoring subsystems 400 which is determined according to the monitoring execution conditions. For example, at a different monitoring place immediately after the monitoring place where the monitoring subsystem 400 is installed, a monitoring subsystem 400 is additionally installed to perform monitoring and effective monitoring is not performed when the same vehicle as that of the previous monitoring execution condition passes through the different monitoring place. Therefore, rather than simply counting the number of vehicles that have passed through each monitoring place, the passage extent information generator 191 allocates scores based on the situations of vehicles when the vehicles pass through the monitoring place and sums the scores for each monitoring place to generate passage extent information.

Particularly, in the present embodiment, the passage extent information generator 191 allocates a higher score as the total amount billed after the vehicle was previously monitored increases from the viewpoint of detecting or preventing evasion of billing of a large amount. In the case of the example of FIG. 4, it is assumed that the passage extent information generator 191 allocates, as a score at the monitoring place P13, for example, a score having a value according to an amount billed at the billing point P12 through which the vehicle has passed after being monitored at the monitoring place P11 as the previous monitoring.

The passage extent information generator 191 may also allocate a score on the basis of a criterion other than the amount billed after the vehicle was previously monitored. For example, the passage extent information generator 191 may allocate a score on the basis of a travel distance of the vehicle after the vehicle was previously monitored or an elapsed time after the vehicle was previously monitored. The passage extent information generator 191 may also allocate a score on the basis of a plurality of parameters selected from the billed amount, the travel distance, the elapsed time, and the like. In this case, the plurality of parameters may be converted into respective scores and the scores may then be summed or the plurality of parameters may be multiplied together and the multiplication result may then be converted into a score. The method of obtaining a score may be appropriately set.

Figure 5:
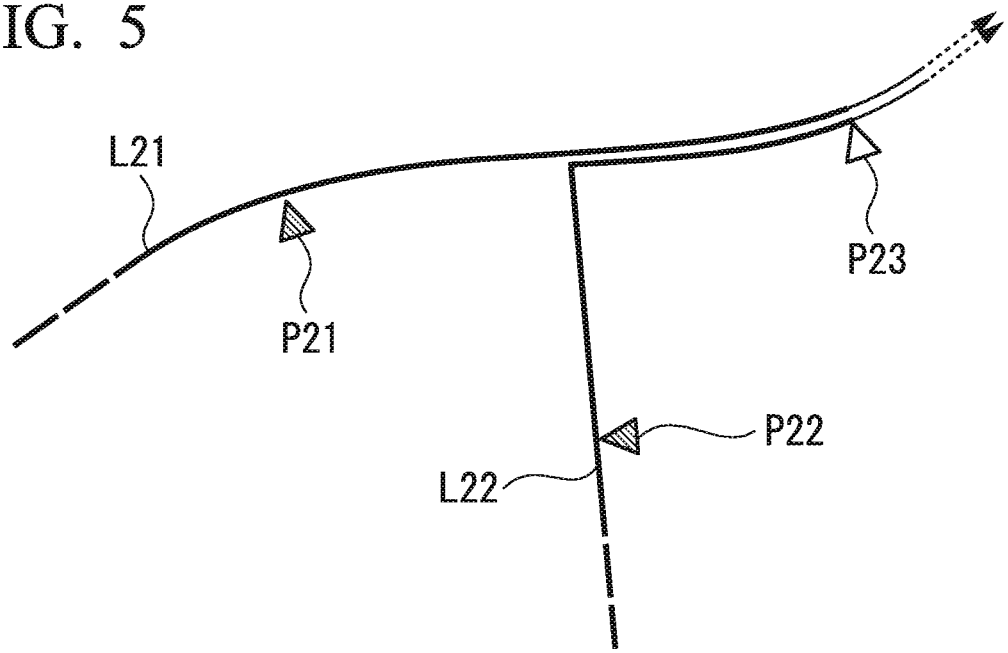
FIG. 5 is an explanatory diagram illustrating exemplary travel routes of a plurality of vehicles that pass through the same monitoring point in the embodiment.

FIG. 5 is an explanatory diagram illustrating exemplary travel routes of a plurality of vehicles that pass through the same monitoring place. In FIG. 5, a line L21 indicates a travel route of a vehicle and a line L22 indicates a travel route of another vehicle. Points P21 and P22 indicate billing points. A point P23 indicates a monitoring place where monitoring is not performed by the monitoring subsystem 400 and which is to be a candidate thereafter.

In the example of FIG. 5, the passage extent information generator 191 calculates a score due to a vehicle that travels along the line L21 and a score due to a vehicle that travels along the line L22. That is, first, the passage extent information generator 191 calculates a score from an amount billed at the billing point P21 for the vehicle that travels along the line L21. The passage extent information generator 191 also calculates a score from an amount billed at the billing point P22 for the vehicle that travels along the line L22. The passage extent information generator 191 then calculates, as a score of the monitoring place P23, the sum of the scores of the vehicles that travel along the lines L11 and L12 that pass through the monitoring place P23. In this manner, for each monitoring place, the passage extent information generator 191 calculates scores respectively for vehicles that pass through the monitoring place and sums the scores to generate passage extent information.

The passage extent information generator 191 may also generate map information by storing, in association with monitoring places which are monitoring execution conditions, respective scores of the monitoring places which indicate the extents of passage of vehicles to be monitored as passage extent information.

The candidate selector 192 selects one or more candidates from a plurality of candidates including at least one of a place for vehicle monitoring and a time for vehicle monitoring on the basis of the passage extent information. For example, for each combination of candidate monitoring execution conditions stored in the storage unit 180, the candidate selector 192 sums scores calculated by the passage extent information generator 191 for the candidate monitoring execution conditions and selects a combination with the highest score.

(Operation of Monitoring Plan Evaluation Server Device)

The operation of the monitoring plan evaluation server device 100 will now be described with reference to FIG. 6.

Figure 6:
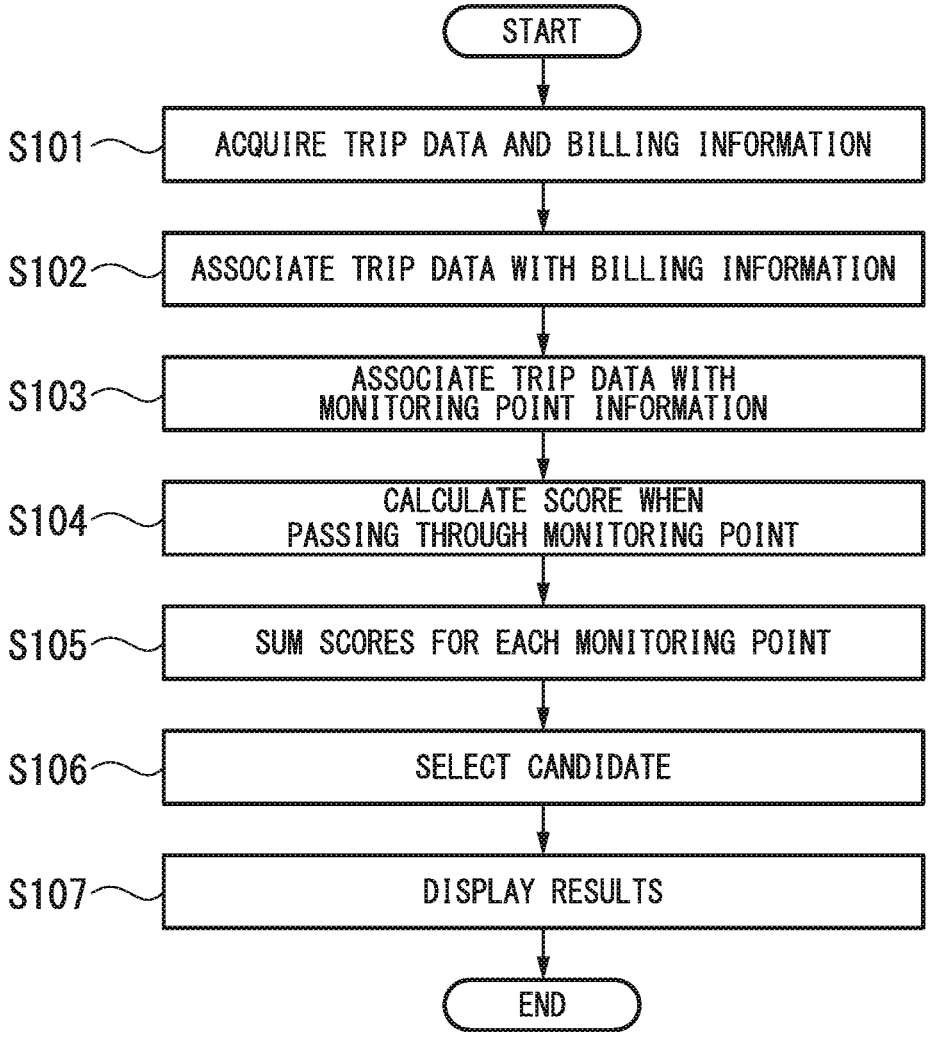
FIG. 6 is a flowchart illustrating an example process sequence in which the monitoring plan evaluation server device selects one candidate from a plurality of candidates for a combination of monitoring points in the embodiment.

FIG. 6 is a flowchart illustrating an example process sequence in which the monitoring plan evaluation server device 100 selects at least one candidate from a plurality of candidates for a monitoring place which are candidate monitoring execution conditions. The monitoring plan evaluation server device 100 performs the procedure of FIG. 6, for example, in response to a user's manipulation performed for instructing that candidate monitoring execution condition information be selected.

In the procedure of FIG. 6, the communication unit 110 acquires trip data and billing information from the billing server device 200 (step S101).

The passage extent information generator 191 may calculate a billing amount from the trip data. For example, the storage unit 180 stores the positions of billing points and respective billing amounts for vehicle types in advance and the passage extent information generator 191 calculates a billing amount on the basis of the vehicle type and the position of the vehicle indicated by the trip data. This allows the passage extent information generator 191 to easily deal with addition, removal, or arrangement change of billing points, change of billing amounts, and the like.

Then, the passage extent information generator 191 associates the billing information acquired in step S101 with the trip data acquired in step S101 on the basis of the on-board unit ID and the date and time of billing (step S102). This makes it possible to determine places and timings where and when billing has been made and billed amounts in travels indicated by the trip data.

The passage extent information generator 191 then associates monitoring places indicated by the candidate monitoring execution condition information with the trip data on the basis of the positions of the monitoring places (step S103). This makes it possible to determine places and timings where and when vehicles have passed through the monitoring places in travels indicated by the trip data.

The passage extent information generator 191 then calculates a score when a vehicle passes through a monitoring place (step S104). Specifically, for each passage of a vehicle through a monitoring place which is indicated by the trip data through the association of step S103, the passage extent information generator 191 calculates a score allocated to the monitoring place on the basis of the sum of amounts billed after the vehicle has passed through the previous monitoring place.

The passage extent information generator 191 then sums scores calculated in step S104 for each monitoring place to calculate a score of each monitoring place as passage extent information (step S105).

The candidate selector 192 then selects monitoring places on the basis of scores indicating the passage extent information which have been acquired in step S105 (step S106). Here, one or a plurality of monitoring places may be selected. In the case where a plurality of monitoring places is selected, a specified number of monitoring places are selected in decreasing order of the score indicating the passage extent information. Each candidate monitoring execution condition may also be constructed of a combination of monitoring places, and a plurality of such combinations may be stored and one or a plurality of combinations may be selected. In this case, the passage extent information generator 191 calculates the sum of scores of all monitoring places included in each combination of monitoring places as a score of the combination and selects a combination of monitoring places with the highest score.

The display unit 120 then displays the result of selection of step S106 (step S107).

Thereafter, the procedure of FIG. 6 is terminated.

The passage extent information generator 191 may also generate passage extent information with reference to other information in addition to the score acquired from the trip data. For example, the passage extent information generator 191 may generate passage extent information by considering, in the score, an evaluation value of the result of monitoring that has been actually performed at the monitoring place. For example, a vehicle which has a history of cheating may be given an evaluation value and the evaluation value may be added to the score described above or the vehicle may be given an evaluation value and the score described above may be multiplied by the evaluation value. An evaluation value for a vehicle having a history of cheating may also be changed on the basis of an elapsed time or a travel distance after cheating has been done. The evaluation value obtained from only the history of cheating may itself be used as the score rather than obtaining the score on the basis of at least one of an elapsed time, a travel distance, and a billed amount after monitoring has been performed.

As described above, the communication unit 110 acquires trip data and vehicle monitoring information of each of a plurality of vehicles. By considering the results of monitoring of each vehicle acquired from the vehicle monitoring information, the passage extent information generator 191 may generate passage extent information indicating the extent of passage of vehicles that are to be monitored at a monitoring place which is a condition indicated by each candidate monitoring execution condition. Through this passage extent information, it is possible to provide information for predicting a monitoring place where it is possible to efficiently detect a vehicle which is to be monitored, i.e., a vehicle where it is highly likely that vehicle-related cheating has been done. In the case where a monitoring time is included as a condition indicated by the candidate monitoring execution condition, it is possible to provide information for predicting a monitoring time where it is possible to efficiently detect a vehicle where it is highly likely that vehicle-related cheating has been done at the monitoring time.

The candidate selector 192 selects one or more candidate monitoring execution conditions from a plurality of candidate monitoring execution conditions on the basis of the passage extent information generated by the passage extent information generator 191.

This allows the operator of the automatic billing system 1 to efficiently detect a vehicle where cheating has been done such as a vehicle to which no on-board unit 310 is mounted or a vehicle to which an improper on-board unit 310 is mounted by installing monitoring subsystems 400 to monitor candidates, each including at least one of a monitoring place and a monitoring time, which are candidate monitoring execution conditions selected by the candidate selector 192.

Here, as described above, the passage extent information generator 191 may generate map information including information, which indicates the extent of passage of vehicles that are to be monitored, as passage extent information.

This allows the operator of the automatic billing system 1 to determine a place or a time where or when to perform monitoring while viewing, on a map, locations where it is expected that it is possible to efficiently detect a vehicle to which no on-board unit 310 is mounted.

In the present embodiment, the passage extent information generator 191 extracts at least one of a monitoring place and a monitoring time where and when a vehicle has been monitored last on the basis of vehicle monitoring information while extracting a candidate monitoring execution condition through which the vehicle has passed after the monitoring place or the monitoring time where or when the vehicle has been monitored last on the basis of a travel history indicated by trip data and then generates the passage extent information on the basis of at least one of a time interval, a travel distance, and a billed amount from when the vehicle has been monitored last to when the vehicle has passed through the extracted candidate monitoring execution condition.

This allows the passage extent information generator 191 to generate passage extent information indicating an extent that varies according to at least one of the time interval, the travel distance, and the billed amount from when the vehicle has been monitored last to when the vehicle has passed through the extracted candidate monitoring execution condition. Therefore, it is possible to more highly evaluate a condition indicated by the candidate monitoring execution condition as a condition where a vehicle to be monitored is passing as the candidate monitoring execution condition is passed by a larger number of vehicles when a time has elapsed after they have been monitored or the candidate monitoring execution condition is passed by a larger number of vehicles which have traveled a long distance or to which a large amount has been billed after they have been monitored, and it is possible to consider the time interval, the travel distance, and the billed amount when the monitoring execution condition is determined.

In the present embodiment, the passage extent information generator 191 may obtain at least a billed amount from when the vehicle has been monitored last to when the vehicle has passed through the extracted candidate monitoring execution condition and may generate passage extent information indicating that the efficiency of monitoring through a condition indicated by the candidate monitoring execution condition increases as the billed amount of the vehicle passing through the candidate monitoring execution condition increases.

This allows the passage extent information generator 191 to present a place or a time suitable for monitoring for preventing or detecting evasion of billing of a large amount. Therefore, for example, by performing monitoring at the place or the time, the operator of the automatic billing system can efficiently perform monitoring for preventing or detecting evasion of billing of a large amount.

In the present embodiment, the trip data or vehicle monitoring information used by the passage extent information generator 191 is actual measured data which has been acquired from an on-board unit mounted to a vehicle that actually travels but the trip data or vehicle monitoring information is not limited to actual measured data. The passage extent information generator 191 may generate passage extent information using trip data and vehicle monitoring information which is acquired as a virtual vehicle travels and is monitored through simulation, in addition to or instead of trip data acquired from an on-board unit or vehicle monitoring information generated from data acquired from the monitoring subsystem 400. Using the trip data and vehicle monitoring information acquired through simulation, the passage extent information generator 191 can deal with cases in which only a small amount of actual measured data has been accumulated.

A program for realizing the functionality of all or a part of the controller 190 may be recorded on a computer readable recording medium and a process of each part may be performed by loading and executing the program recorded on the recording medium on a computer system. Here, it is assumed that the "computer system" includes an OS or hardware such as peripheral devices.

It is also assumed that the "computer system" also includes website provision environments (or display environments) in the case where a WWW system is used.

The "computer readable recording medium" includes a portable medium such as a flexible disk, a magnetic optical disk, or a compact disk and a non-temporary storage medium typified by a storage device such as a built-in hard disk in a computer system. It is also assumed that the "computer readable recording medium" includes a temporary storage medium that dynamically holds a program for a short time, like a communication wire for transmitting a program via communication lines such as telephone lines or a network such as the Internet, and a non-temporary storage medium that holds a program for a certain time, like an internal volatile memory in a computer system which is a server or a client. The program described above may be one for realizing a part of the functionality described above and may also be one that is able to realize the functionality described above in combination with a program which has already been stored in the computer system.

Although the embodiments of the present invention have been described above in detail with reference to the drawings, detailed configurations thereof are not limited to those of the embodiments and include design modifications or the like without departing from the nature of the present invention.

INDUSTRIAL APPLICABILITY

The present invention relates to a monitoring plan evaluation system which includes a vehicle monitoring information acquisition unit which acquires vehicle monitoring information indicating a result of monitoring of a vehicle, the vehicle monitoring information including monitoring execution condition information indicating at least one of a monitoring place and a monitoring time of the vehicle and information of the vehicle that has been subjected to monitoring at the monitoring place or the monitoring time, a movement information acquisition unit which acquires vehicle movement information regarding movement of each of a plurality of vehicles, and a passage extent information generator which generates passage extent information, which indicates an extent of passage of a vehicle that is to be monitored in a condition indicated by a candidate monitoring execution condition including at least one of a place and a time where and when to monitor vehicles, on the basis of the vehicle movement information and the vehicle monitoring information.

The present invention also relates to a monitoring plan evaluation method which includes a vehicle monitoring information acquisition step acquiring vehicle monitoring information indicating a result of monitoring of a vehicle, the vehicle monitoring information including monitoring execution condition information indicating at least one of a monitoring place and a monitoring time of the vehicle and information of the vehicle that has been subjected to monitoring at the monitoring place or the monitoring time, a movement information acquisition step acquiring vehicle movement information regarding movement of each of a plurality of vehicles, and a passage extent information generation step generating passage extent information, which indicates an extent of passage of a vehicle that is to be monitored in a condition indicated by a candidate monitoring execution condition including at least one of a place and a time where and when to monitor vehicles, on the basis of the vehicle movement information and the vehicle monitoring information.

According to the monitoring plan evaluation system and the monitoring plan evaluation method described above, it is possible to provide information for predicting at least one of a place and a time where and when it is possible to efficiently detect vehicles to which no on-board units are mounted.

BRIEF DESCRIPTION OF THE REFERENCE SYMBOLS

1: automatic billing system
100: monitoring plan evaluation server device
110: communication unit
120: display unit
180: storage unit
190: controller
191: passage extent information generator
192: candidate selector
200: billing server device

The invention claimed is:

1. A monitoring plan evaluation system comprising:

a vehicle monitoring information acquisition unit which acquires vehicle monitoring information indicating a result of monitoring of a vehicle, the vehicle monitoring information including monitoring execution condition information indicating at least one of a monitoring place and a monitoring time of the vehicle and information of the vehicle that has been subjected to monitoring at the monitoring place or the monitoring time;

a movement information acquisition unit which acquires vehicle movement information regarding movement of each of a plurality of vehicles; and a passage extent information generator which generates passage extent information, which indicates an extent of passage of the vehicle that is to be monitored in a condition indicated by a candidate monitoring execution condition including at least one of a place and a time where and when to monitor the vehicles, based on the vehicle movement information and the vehicle monitoring information, wherein the passage extent information generator calculates a passage extent evaluation value based on situations of the vehicles when the vehicles pass through the monitoring place and sums the passage extent evaluation value for each monitoring place to generate the passage extent information, wherein the vehicle monitoring information includes a cheating behavior of the vehicle that is cheating, wherein the passage extent evaluation value is calculated by considering an evaluation value of a result of monitoring that has been actually performed at the monitoring place whether a cheating is actually done, wherein the evaluation value is added for the vehicle which has a history of cheating, wherein the evaluation value for the vehicle having the history of cheating is changeable on the a basis of an elapsed time or a travel distance after cheating has been done, and wherein the cheating comprises not mounting an on-board unit or mounting a non-corresponding on-board unit to the vehicle.

2. The monitoring plan evaluation system according to claim 1, comprising a candidate selector which selects one or more candidate monitoring execution conditions from a plurality of candidate monitoring execution conditions on the basis of the passage extent information.

3. The monitoring plan evaluation system according to claim 1, wherein the passage extent evaluation value is calculated by extracting at least one of the monitoring place and the monitoring time where and when the vehicle has been monitored last based on the vehicle monitoring information while extracting the candidate monitoring execution condition through which the vehicle has passed after the monitoring place or the monitoring time where or when the vehicle has been monitored last based on a travel history indicated by the vehicle movement information and then the passage extent evaluation value is calculated based on at least one of a time interval, a travel distance, and a billed amount from when the vehicle has been monitored last to when the vehicle has passed through the extracted candidate monitoring execution condition.

4. The monitoring plan evaluation system according to claim 3, wherein the passage extent evaluation value is calculated by obtaining at least the billed amount from when the vehicle has been monitored last to when the vehicle has passed through the extracted candidate monitoring execution condition and the passage extent evaluation value is calculated such that the extent of passage of the vehicle that is to be monitored increases as the billed amount of the vehicle passing through the candidate monitoring execution condition increases.

5. A monitoring plan evaluation system comprising:

a vehicle monitoring information acquisition unit which acquires vehicle monitoring information indicating a result of monitoring of a vehicle, the vehicle monitoring information including monitoring execution condition information indicating at least one of a monitoring place and a monitoring time of the vehicle and information of the vehicle that has been subjected to monitoring at the monitoring place or the monitoring time;

a movement information acquisition unit which acquires vehicle movement information regarding movement of each of a plurality of vehicles; and a passage extent information generator which generates passage extent information, which indicates an extent of passage of the vehicle that is to be monitored in a condition indicated by a candidate monitoring execution condition including at least one of a place and a time where and when to monitor the vehicles, based on the vehicle movement information and the vehicle monitoring information, wherein the passage extent information generator calculates a passage extent evaluation value based on situations of the vehicles when the vehicles pass through the monitoring place and sums the passage extent evaluation value for each monitoring place to generate the passage extent information, wherein the vehicle monitoring information includes a cheating behavior of the vehicle that is cheating, wherein the passage extent evaluation value is calculated by considering an evaluation value of a result of monitoring that has been actually performed at the monitoring place whether a cheating is actually done, wherein the evaluation value is added for the vehicle which has a history of cheating, wherein the evaluation value for the vehicle having the history of cheating is changeable on a basis of an elapsed time or a travel distance after cheating has been done, and wherein the cheating comprises not mounting an on-board unit or mounting a non-corresponding on-board unit to the vehicle.

* * * * *